US005749496A

United States Patent [19]

DeJonge, Sr. et al.

[11] Patent Number: 5,749,496

[45] Date of Patent: May 12, 1998

[54] SQUEEZE AND ROTATE TO LIFT CAPTIVE CAP DISPENSER

[75] Inventors: Stuart DeJonge, Sr., Easton, Pa.; Jack Weinstein, Manchester Township, Ocean County, N.J.

[73] Assignee: Primary Delivery Systems, Inc., Easton, Pa.

[21] Appl. No.: 665,988

[22] Filed: Jun. 19, 1996

[51] Int. Cl.[6] ..... B65D 47/00; B67D 5/06

[52] U.S. Cl. ..... 222/153.14; 215/216; 215/228; 222/519; 222/553

[58] Field of Search ..... 222/153.14, 519, 222/549, 553; 215/228, 216–218

[56] References Cited

U.S. PATENT DOCUMENTS

| | | | |
|---|---|---|---|
| 2,805,800 | 9/1957 | Malick et al. | 222/519 |
| 2,877,918 | 3/1959 | Gardner . | |
| 3,121,519 | 2/1964 | Cherba | 222/549 X |
| 3,258,179 | 6/1966 | Cherba | 222/553 X |
| 3,261,513 | 7/1966 | Moran | 222/519 |
| 3,317,093 | 5/1967 | Moran | 222/549 X |
| 3,471,066 | 10/1969 | Micallef | 222/519 |
| 3,713,586 | 1/1973 | Webster | 222/519 X |
| 3,910,463 | 10/1975 | Reese | 222/153.14 |
| 4,146,277 | 3/1979 | Santoro | 215/227 X |
| 4,314,656 | 2/1982 | Kessler . | |
| 4,350,508 | 9/1982 | Santoro et al. | 215/228 X |
| 4,358,031 | 11/1982 | Lohrman | 222/153.14 |
| 4,383,618 | 5/1983 | Dougherty | 215/216 |
| 4,452,363 | 6/1984 | Davis | 215/216 |
| 4,545,492 | 10/1985 | Firestone | 215/228 X |
| 4,591,074 | 5/1986 | Kennings . | |
| 4,784,288 | 11/1988 | Jennings . | |
| 4,893,728 | 1/1990 | Jennings . | |
| 4,961,515 | 10/1990 | Schreiber | 222/553 X |
| 4,971,203 | 11/1990 | Weinstein . | |
| 5,111,967 | 5/1992 | Schreiber | 222/549 X |
| 5,141,129 | 8/1992 | Jennings . | |
| 5,284,273 | 2/1994 | Schreiber | 222/553 X |
| 5,476,181 | 12/1995 | Seidler . | |

FOREIGN PATENT DOCUMENTS

| | | | |
|---|---|---|---|
| 1179000 | 5/1959 | France | 222/553 |
| 6423347 | 7/1960 | Italy | 222/553 |

*Primary Examiner*—Kevin P. Shaver
*Attorney, Agent, or Firm*—Kenneth P. Glynn, Esq.

[57] ABSTRACT

The present invention is a semi-flexible captive cap closure which includes a non-removable cap that rotates between a closed and open position and has opposing squeeze points that must be biased inwardly in order to open the cap. The preferred embodiment of the present invention includes a container which has a base and a neck for retaining the cap. The neck has at least one inclined recess track which has at least one impression which is adequately sized to correspond to a protrusion located on the cap. When the cap is in a closed position a user grasps the cap at the opposing squeeze points and applies inward pressure in order to displace the protrusion from the impression and to allow rotation to an open position. The cap is maintained in an open position either by frictional contact between the track and protrusion or by a second corresponding impression. The cap further includes a dispensing orifice which is closed by the neck of the container when the cap is in a closed position and opened when the cap is in an open position.

27 Claims, 3 Drawing Sheets

SQUEEZE AND ROTATE TO LIFT CAPTIVE CAP DISPENSER

BACKGROUND OF THE INVENTION

1. Field of the Invention

The present invention relates to child resistant caps, and more particularly to semi-flexible captive caps which rotate between a closed and open position and have a pair of squeeze points that must be biased inwardly in order to open the caps.

2. Information Disclosure Statement

Safety caps have been well known for at least three decades and literally come in many hundreds of shapes and forms with diverse mechanisms for achieving safety. The objective of such devices is to slow down or prevent the opening of a dispenser by a child to ultimately reduce or prevent use of a medication or dangerous or hazardous material by a young child who may unwittingly consume a portion of the contents and suffer severe consequences. The following eight patents represent several variations on rotating safety caps which exemplify the art.

U.S. Pat. No. 2,877,918 to Leonal P. Gardner teaches a pliant snap cap for bottles disposed for limited axial movement on the neck of a bottle. The cap has a closed position and an open dispensing position and is forced onto the neck of a bottle so as to make it difficult to remove. The bottle has an annular ledge so as to retain the cap in an open or closed position and to insure a snap of the cap when moving from one position to another.

U.S. Pat. No. 4,314,656 to Milton Kessler teaches a childproof push-pull container having a secured cap which moves axially to the body portion. The formation defines recesses located 180° from each other such that when the cap is in a closed position, recesses and a flange are in an interlocking relationship. To open the cap, force is applied to the cap's skirt at opposed circumferential locations until the flange is removed from the recesses.

U.S. Pat. No. 4,591,074 to Kenneth L. Kennings teaches a container comprising an outer hollow element and a hollow inner element mounted for movement within the outer element. The inner element is movable between a closed and an open position. When the inner element is moved into an open position and a portion is extended from the outer element, a hole is exposed such that contents may be dispensed therethrough.

U.S. Pat. No. 4,784,288 to Kenneth L. Jennings teaches an article dispenser made of plastic having a chamber and a dispensing control member adapted for slidable engagement with the dispenser whereby to selectively place a first dispenser aperture in alignment with a second aperture, rotation or axial movement to a set position is required to provide for opening the dispenser.

U.S. Pat. No. 4,893,728 to Paul D. Jennings and Kenneth L. Jennings teaches a dispenser made of plastic having a chamber and a dispensing control member adapted for slidable engagement with the dispenser whereby to selectively place a first dispenser aperture in alignment with a second aperture, rotation or axial movement to a set position is required to provide for opening the dispenser.

U.S. Pat. No. 4,971,203 to Jack Weinstein teaches an elongated tubular body and cap member telescopically connected therewith. Both the body and cap member contain orifices which are not aligned horizontally and are not vertically aligned when the cap is in a closed position. A horizontal track on either the body or the cap allows the cap, after being rotated relative to the body, to be pulled upwardly so that the orifices align to allow dispensing therethrough.

U.S. Pat. No. 5,141,129 to Paul D. Jennings teaches an article dispenser having a container and a dispenser control member which is in coaxial contiguous engagement with the container. The dispenser control member has a plurality of channels, one of which has a bead thereon and the control member has an undercut or wedge shaped tab for residing in the channels. As the tab is rotatably moved from one channel to another relative to the container, differing degrees of constraint are achieved.

U.S. Pat. No. 5,476,181 to David Seidler teaches a child-resistant dispenser including a container having a neck and cap which has an opening thereon. The cap is rotatably supported by the neck. One of the cap and neck has at least one track thereon and the other of the neck or cap has at least one projection. Upon a predetermined orientation of the cap with respect to the neck, the projection is aligned with the track and the cap may be moved into an open position.

Notwithstanding the prior art in this field, it is believed that the present invention, which comprises a non-removable rotatable captive cap with opposing squeeze points as described herein, is neither taught nor rendered obvious.

SUMMARY OF THE INVENTION

The present invention is a semi-flexible captive cap closure which includes a non-removable cap that rotates between a closed and open position and has opposing squeeze points that must be biased inwardly in order to open the cap. The preferred embodiment of the present invention includes a container which has a base and a neck for retaining the cap. The neck has at least one inclined recess track which has at least one impression which is adequately sized to correspond to a protrusion which is located on the cap equally between the opposing squeeze points. In the closed position, the protrusion is securely retained in the impression and cannot be removed therefrom unless the protrusion is displaced from the impression. Thus, when the cap is in a closed position a user grasps the cap at the opposing squeeze points and applies inward pressure in order to displace the protrusion from the impression and to allow rotation to an open position. The cap is maintained in an open position either by frictional contact between the track and protrusion or, alternatively, by a second corresponding impression. The cap further includes a dispensing orifice which is closed by the neck of the container when the cap is in a closed position and opened when the cap is in an open position. Additionally, the cap may be a single-shell embodiment which has one depending skirt or annular sidewall for engaging the neck of the container, or it may be a double-shell embodiment which has a pair of depending skirts or sidewalls for engaging the neck of the container.

BRIEF DESCRIPTION OF THE DRAWINGS

The present invention will be more fully understood when the specification herein is taken in conjunction with the drawings appended hereto, wherein.

DETAILED DESCRIPTION OF THE PRESENT INVENTION

The present invention is a semi-flexible captive cap closure which includes a non-removable cap that rotates between a closed and open position and has opposing squeeze points that must be biased inwardly in order to open the cap. The preferred embodiment of the present invention includes a container which has a base and a neck for retaining the cap. The neck has at least one inclined recess track which has at least one impression which is adequately sized to correspond to a protrusion which is located on the cap equally between the opposing squeeze points. In the closed position, the protrusion is securely retained in the impression and cannot be removed therefrom unless the protrusion is displaced from the impression. Thus, when the cap is in a closed position a user grasps the cap at the opposing squeeze points and applies inward pressure in order to displace the protrusion from the impression and to allow rotation to an open position. The cap is maintained in an open position either by frictional contact between the track and protrusion or, alternatively, by a second corresponding impression. The cap further includes a dispensing orifice which is closed by the neck of the container when the cap is in a closed position and opened when the cap is in an open position. Additionally, the cap may be a single-shell embodiment which has one depending skirt or annular sidewall for engaging the neck of the container, or it may be a double-shell embodiment which has a pair of depending skirts or sidewalls for engaging the neck of the container. In the most preferred embodiment, the cap includes a moisture vapor transfer plug which completely seals the closure when the cap is in the closed position and a desiccant holder.

The container may comprise any variety of shapes and sizes and the cap may likewise comprise any variety of sizes. The cap and container may be made of molded plastic or any other suitable material known to be used in the art.

Figure 1:
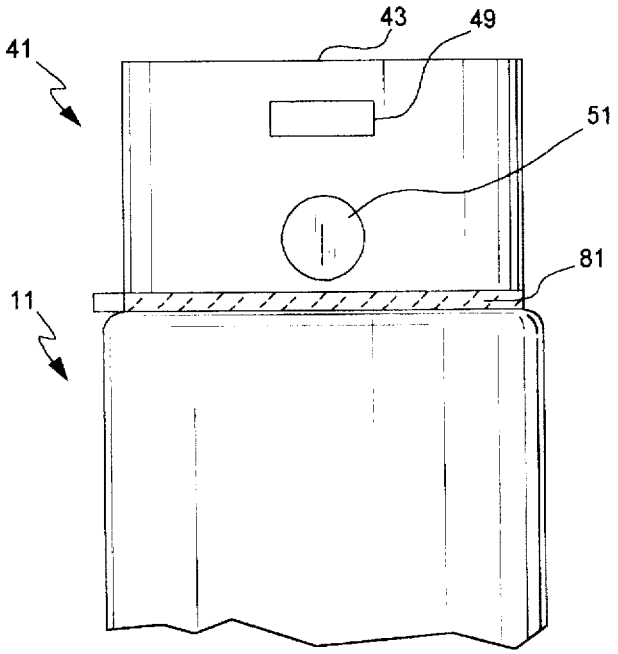
FIG. 1 shows a side view of a present invention squeeze and rotate to lift captive cap dispenser.

FIG. 1 shows a side view of a present invention squeeze and rotate to lift single-shell captive cap dispenser. What is meant by single-shell is a cap having only one annular depending skirt or sidewall. Here, captive cap 41 is shown being in a closed position and being non-removably attached to container 11. Cap 41 has top 43 and annular sidewall 47 which engages the neck (see FIG. 4) of container 11. Cap 41 has dispensing orifice 49 which is located within sidewall 47 and which is closed off by the neck of container 11 when cap 41 is in a closed position and opened when cap 41 is in an open position, as is more adequately described below with respect to FIG. 4. Sidewall 47 further includes squeeze point 51 and opposing squeeze point 53 (shown in FIG. 3). Cap 41 preferably includes tamper resistant ring 81 which comprises internal notches that correspond to notches located on the neck of container 11, as is described in more detail below with respect to FIG. 4.

Figure 2:
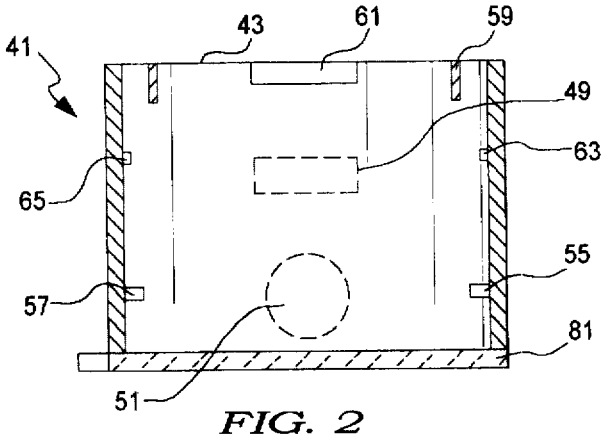
FIG. 2 shows a cut side view of a present invention single shell captive cap used in the dispenser shown in FIG. 1.

FIG. 2 shows a cut side view of a present invention single-shell captive cap used in the dispenser shown in FIG. 1. Identical parts are identically numbered. Referring to FIGS. 1 and 2, sidewall 47 has first locking protrusion 55 and second locking protrusion 57. Sidewall 47 also has first safety protrusion 63 and second safety protrusion 65. Top 43 has annular moisture vapor transfer plug 59 and desiccant holding means 61, which are employed in a more preferred embodiment cap.

Figure 3:
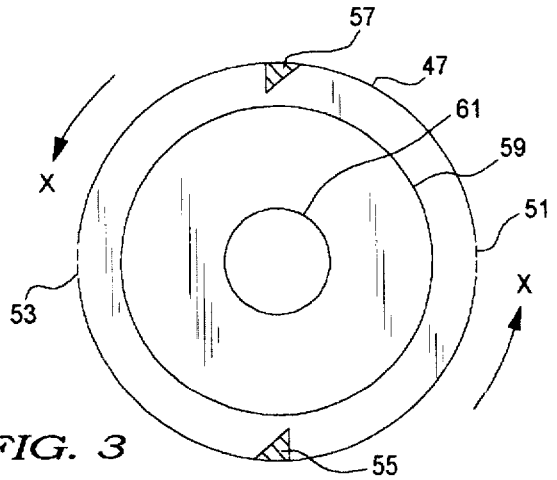
FIG. 3 shows a bottom view of a present invention single shell captive cap as shown in FIG. 2.

FIG. 3 shows a bottom view of a present invention single shell captive cap, as shown in FIG. 2, illustrating details of squeeze points 51 and 53, locking protrusions 55 and 57, plug 59 and desiccant holding means 61. Identical parts are identically numbered. Here, locking protrusions 55 and 57 comprise a tapered construction. The tapered construction permits rotation in direction X only when inward pressure is applied to squeeze points 51 and 53, as will be more fully understood with reference to FIGS. 1 through 4. As shown, desiccant holding means 61 is a circular extension suited for force fitting a desiccant member, such as calcium oxide, therein.

Figure 4:
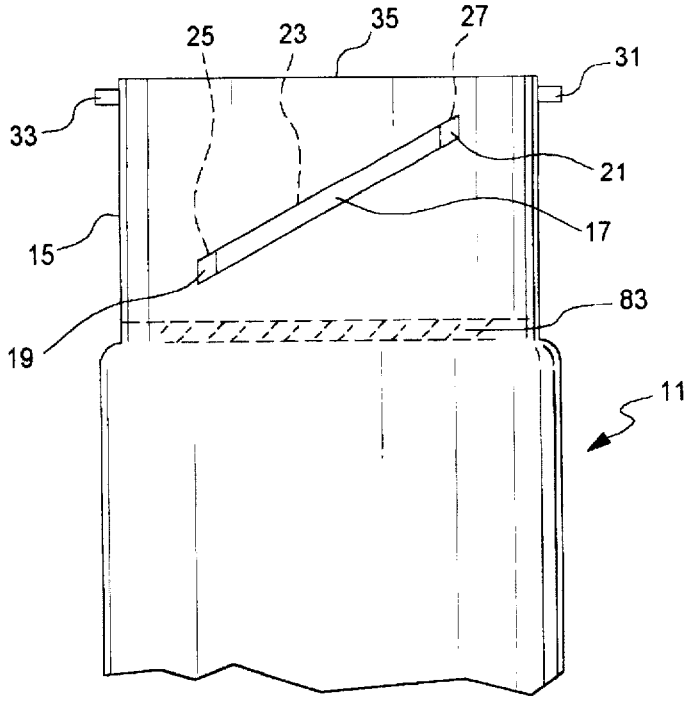
FIG. 4 shows a side view of a container for a present invention squeeze and rotate to lift dispenser.

FIG. 4 shows a side view of a container for a present invention squeeze and rotate to lift captive cap dispenser. Here, container 11 has neck 15 which is shown having recess track 17 and has opposing recess track 23 (not shown here) and safety protrusions 31 and 33 and has open mouth 35. Recess track 17 is shown having locking impressions 19 and 21 and recess track 23 has like impressions 25 and 27 (not shown here). Impressions 19,21, 25 and 27 have greater depth than tracks 17 and 23. Neck 15 is shown comprising tamper notches 83 which correlate to notches on tamper ring 81 of cap 41 when cap 41 is in a consumer-ready, closed and packaged condition.

Referring to FIGS. 1 through 4, cap 41 is non-removably attached to neck 21. Protrusions 55 and 57 reside in tracks 17 and 23 respectively, thereby securing cap 41 to neck 15. Thus, rotation of cap 41 relative to neck 15 results in either shifting cap 41 from a closed position to an open position or vice versa, depending on the direction of rotation. To initially open the present invention, a cap which employs tamper ring 81 may only be rotated after removal of or damage to tamper ring 81. The relative incline of tracks 17 and 23 generates an elevating and lowering effect upon cap 41, much like conventional threading. Impressions 19 and 21 are adequately shaped to receive protrusion 55 therein and impressions 25 and 27 (not shown here) are adequately shaped to receive protrusion 57 therein. Specifically, when cap 41 is in a closed position, protrusion 55 resides in impression 19 and protrusion 57 resides in impression 25. Similarly, when cap 41 is in a closed position, moisture vapor transfer plug 59 fits snugly against the inner side of neck 15, thereby producing a precise seal for open mouth 35 and protecting the integrity of any contents. The tapered construction of protrusions 55 and 57 prevents free displacement from impressions 19 and 25. Thus, in order for a user to open cap 41, inward pressure must be applied to squeeze points 51 and 53. Such inward pressure causes protrusions 55 and 57 to be biased outwardly and to be displaced from impressions 19 and 25 but not displaced from tracks 17 and 23. Cap 41 is manually rotated into an open position, and protrusions 55 and 57 permeate impressions 21 and 27 respectively and cap 41 is then retained in an open position. Likewise, orifice 49 is opened by virtue of being elevated above the extent of neck 15. A user may then tilt the present invention and dispense contents out of open mouth 35 and through orifice 49. The tapered construction of protrusions 55 and 57 obstructs further rotation of cap 41 in direction X, but allows frictional rotation in the opposite direction. In other words, cap 41 may only be opened when inward pressure is applied to squeeze points 51 and 57, but may be closed without such inward pressure, either by exerting downward pressure upon cap 41 or by manually rotating cap 41 to a closed position. In a more referred embodiment, neck 15 comprises safety protrusions and cap 41 comprises complimentary safety protrusions. As shown, cap 41 has safety protrusions 63 and 65, and neck 15 has safety protrusions 31 and 33. These protrusions come into opposing contact when cap 41 is rotated into an open position and prevent removal of cap 41 even if force is applied to cap 41 and inward pressure is applied to squeeze points 51 and 53 while cap 41 is in an open position.

While FIGS. 1 through 4 depict the present invention as having two separate tracks and protrusions, it is to be understood that any variety of track and protrusion lifting means may be employed. For example, neck 15 may comprise a single track which extends more than 360° thereabout and cap 41 may employ a protrusion configuration which allows two protrusions to be engaged in the same track at different locations. Likewise, there may be only one track and one protrusion or even a plurality of protrusions and tracks. It is also to be understood that any degree of incline may be employed for a recess track(s), i.e. 20° through 60°. It is to be further understood that recess tracks may be utilized with or without impressions, as is described in more detail below with respect to FIGS. 5 through 7.

Figure 5:
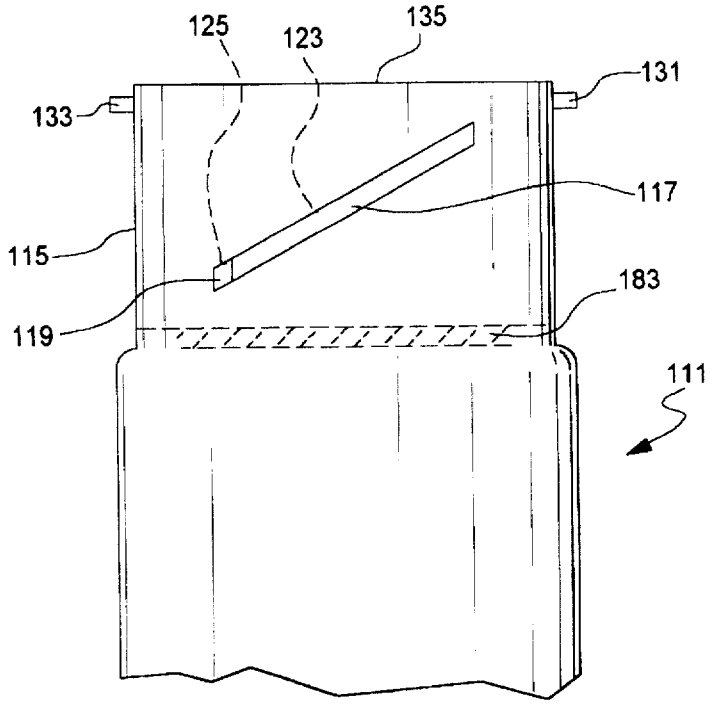
FIG. 5 shows a side view of an alternative embodiment container for a present invention squeeze and rotate to lift dispenser.

FIG. 5 shows a side view of an alternative embodiment container for a present invention squeeze and rotate to lift dispenser for use with a cap as shown in FIG. 2. Here, container 111 has neck 115 which is shown having recess track 117 and has opposing recess track 123 (not shown here). Neck 115 has safety protrusions 131 and 133 and has open mouth 135. Recess track 117 is shown having locking impression 119 and recess track 123 has like impression 125 (not shown here). Impressions 119 and 125 have greater depth than tracks 117 and 123. Neck 115 is shown comprising tamper notches 183 which correlate to notches on tamper ring 81 of cap 41 when cap 41 is in a consumer-ready, closed and packaged condition. As shown, tracks 117 and 123 have only one impression each. These impressions function so as to require inward pressure upon squeeze points 51 and 53 in order to open the cap. However, once in an open position, cap 41 will not be held in place by another impression, but instead by frictional engagement of the tracks by the protrusions. To close the cap, manual rotation or downward pressure upon the cap may be applied without employing inward pressure to the squeeze points.

Figure 6:
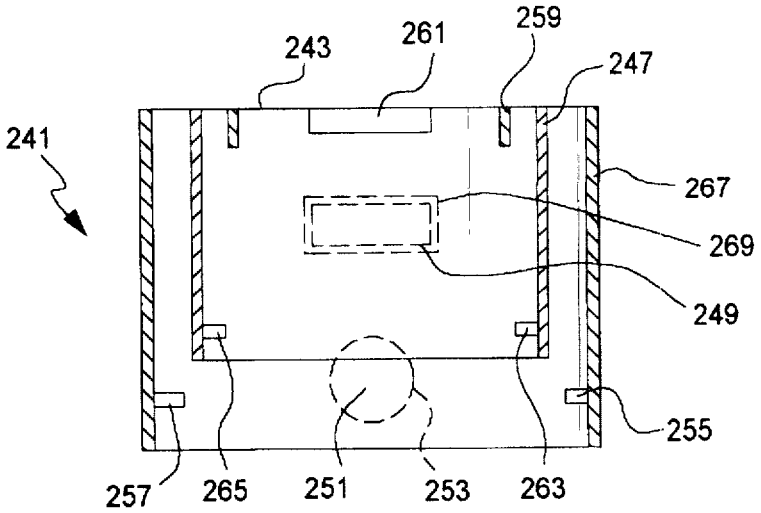
FIG. 6 shows a cut side view of a present invention alternative embodiment double shell captive cap; and, FIG. 7 shows a side view of an alternative embodiment container for use with a present invention squeeze and rotate to lift cap as shown in FIG. 6.
Figure 7:
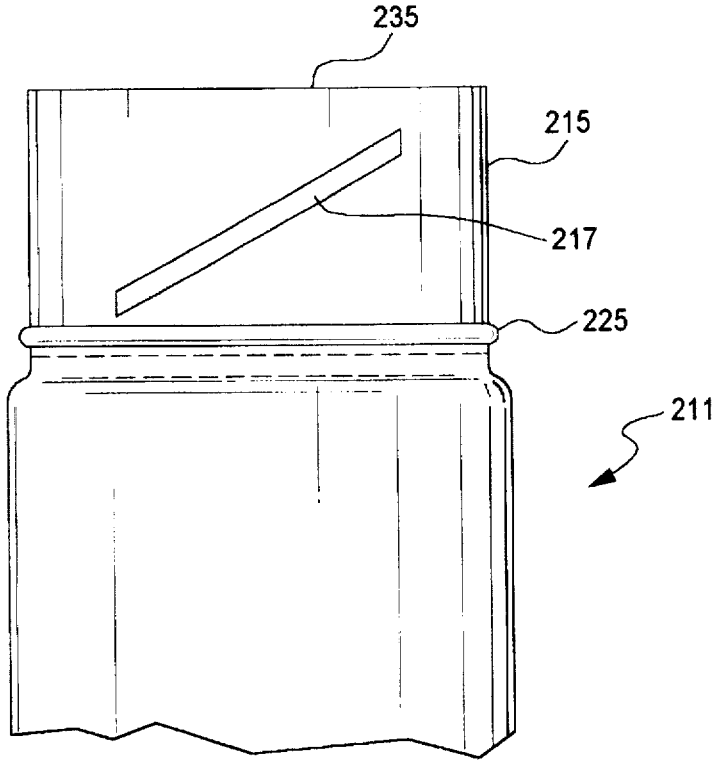

FIG. 6 shows a cut side view of a present invention alternative embodiment double-shell captive cap. What is meant by double-shell is a cap having two depending annular skirts or sidewalls. FIG. 7 shows a side view of an alternative embodiment container for use with a present invention squeeze and rotate to lift double-shell cap as shown in FIG. 6.

Referring to FIGS. 6 and 7, captive cap 241 has top 243 and first annular sidewall 247 which engages neck 215 of container 211. Cap 241 also has second annular sidewall 267 which also engages neck 215 of container 211. Cap 241 has dispensing orifice 249 which is located within sidewall 247 and dispensing orifice 269 which is located within sidewall 267 adjoining orifice 249 and functioning concurrently therewith. Orifice 249 is closed off by neck 215 of container 211 when cap 241 is in a closed position and opened when cap 241 is in an open position. Sidewall 267 includes squeeze point 251 and opposing squeeze point 253 (not shown). Sidewall 267 has first locking protrusion 255 and second locking protrusion 257 which engage neck 215 below annular transfer bead 225. Sidewall 247 has recess track protrusions 263 and 265, which engage track 217 and 223 (not shown) respectively. Top 243 has annular moisture vapor transfer plug 259 and desiccant holding means 261, which are employed in a more preferred embodiment cap. As shown, cap 241 rotates between an open position and a closed position being guided by protrusions 263 and 265 which frictionally engage tracks 217 and 223. To open cap 241, a user must bias squeeze points 251 and 253 inwardly to displace protrusions 255 and 257 and to enable them to surmount annular bead 225. Thus, cap 241 can not be opened unless inward pressure is applied to squeeze points 251 and 253. In the alternative, annular bead 225 may be substituted by impressions which correspond to protrusions 255 and 257.

Referring to FIGS. 1 through 7, it is to be understood that the orifice(s) may be placed in any functional position and may comprise any suitable size or shape. It is also to be understood that a cap may comprise tracks and a neck may comprise tracking protrusions without exceeding the scope of the present invention. It is further understood that the placement of tracks and safety protrusions may vary so as to be functional in a variety of shapes and sizes.

Obviously, numerous modifications and variations of the present invention are possible in light of the above teachings. It is therefore understood that within the scope of the appended claims, the invention may be practiced otherwise than as specifically described herein.

What is claimed is:

1. A captive cap dispenser device closure comprising:

(a) a container having a base for holding contents, a neck and an open mouth, said neck defining said open mouth, said neck having an inner surface and an external surface, said neck external surface having at least a first recess track, said first recess track having a first end and a second end, said first recess track first end having a first impression defined therein, said first recess track second end having a second impression defined therein, said first and second impressions having a greater depth than said first recess track; and (b) a dispenser cap being manually rotatable between a first closed position and a second open position, said cap having means for non-removably retaining said cap to said neck of said container, wherein said cap comprises:

a top and an annular sidewall extending from said top, said top having an inner surface, said annular sidewall having an inner and an outer surface, said annular sidewall being semi-flexible, said annular sidewall also having a dispensing orifice thereon such that said dispensing orifice is closed by said neck when said cap is in said first closed position and open when said cap is in said second open position, said annular sidewall outer surface having a first squeeze point and a second squeeze point opposite said first squeeze point, said annular sidewall inner surface having at least a first locking protrusion, said first locking protrusion being spaced equally between said first and second squeeze points such that said first locking protrusion will be forcibly biased outwardly when inward pressure is applied to said first and second squeeze points, said first locking protrusion being located and confined within said first recess track and being in frictional contact therewith, said first locking protrusion being securely located within said first recess track first impression when said cap is in said first closed position, said first locking protrusion being removably located within said first recess track second impression when said cap is in said second open position, said cap being capable of rotation from said first closed position to said second open position only when said first and second squeeze points are biased inwardly such that said first internal locking protrusion is displaced from said first recess track first impression.

2. The captive cap dispenser device closure of claim 1 wherein said cap top inner surface further includes an annular moisture vapor transfer plug, said moisture vapor transfer plug being in immediate contact with said neck inner surface when said cap is in said first closed position.

3. The captive cap dispenser device closure of claim 1 wherein said cap top inner surface further includes a desiccant retaining member.

4. The captive cap dispenser device closure of claim 1 wherein said captive cap dispenser further comprises:

(a) a second recess track opposite said first recess track, said second recess track having a first end and a second end, said second recess track first end having a first impression defined therein, said second recess track second end having a second impression defined therein; and (b) a second locking protrusion opposite said first locking protrusion, said second locking protrusion being securely located within said second recess track first impression when said cap is in said first closed position, said second internal locking protrusion being removably located within said second recess track second impression when said cap is in said second open position.

5. The captive cap dispenser device closure of claim 1 wherein said captive cap dispenser device further comprises:

(a) a third impression and a fourth impression, said third and fourth impressions being defined within said first recess track between said first and second impressions; and (b) a second locking protrusion being located on said cap annular sidewall inner surface, said second locking protrusion being securely located within said first recess track at a position diametrically opposed to said first locking protrusion, said second locking protrusion being securely located within said fourth impression when said cap is in said first closed position, said second locking protrusion being removably located within said second recess track second impression when said cap is in said second open position, said first locking protrusion being securely located within said first impression when said cap is in said first closed position, said first locking protrusion being removably located in said third impression when said cap is in said second open position.

6. The captive cap dispenser device closure of claim 1 wherein said cap is rotatable from said second open position to said first closed position by manually rotating said cap and without applying inward pressure to said squeeze points.

7. The captive cap dispenser device closure of claim 1 wherein said cap is manually rotatable from said second open position to said first closed position by applying downward pressure upon said cap and without applying inward pressure to said squeeze points.

8. The captive cap dispenser device closure of claim 1 wherein said cap comprises said first recess track and said neck external surface comprises said first locking protrusion.

9. The captive cap dispenser device closure of claim 1 wherein said neck external surface comprises tamper notches and said cap comprises a corresponding removable notched tamper ring such that rotation of said cap from said first closed position to said second open position is only achieved by first manually removing said tamper ring.

10. The captive cap dispenser device closure of claim 1 wherein said neck external surface comprises a first external safety protrusion and a second external safety protrusion and said cap comprises a first internal safety protrusion and a second internal safety protrusion such that said first external safety protrusion and said first internal safety protrusion come in opposing contact with one another when said cap is in said second open position and said second external safety protrusion and said second internal safety protrusion come in opposing contact with one another when said cap is in said second open position whereby further rotation of said cap is prevented and complete removal of said cap is obstructed.

11. The captive cap dispenser device closure of claim 1 wherein said cap annular sidewall outer surface comprises indicia means for indicating where said first and said second squeeze points are located.

12. A captive cap dispenser device closure comprising:

(a) a container having a base for holding contents, a neck and an open mouth, said neck defining said open mouth, said neck having an inner surface and an external surface, said neck external surface having at least a first recess track, said first recess track having a first end and a second end, said first track first end having an impression defined therein; and (b) a dispenser cap being manually rotatable between a first closed position and a second open position, said cap having means for non-removably retaining said cap to said neck of said container, wherein said cap comprises:

a top and an annular sidewall extending from said top, said top having an outer surface and an inner surface, said annular sidewall having an inner and an outer surface, said annular sidewall being semi-flexible, said annular sidewall also having a dispensing orifice thereon such that said dispensing orifice is closed by said neck when said cap is in said first closed position and open when said cap is in said second open position, said annular sidewall outer surface having a first squeeze point and a second squeeze point opposite said first squeeze point, said annular sidewall inner surface having at least a first locking protrusion, said first locking protrusion being spaced equally between said first and second squeeze points such that said first locking protrusions will be forcibly biased outwardly when inward pressure is applied to said first and second squeeze points, said first locking protrusion being located and confined within said first recess track and being in frictional contact therewith, said first locking protrusion being securely located within said first recess track impression when said cap is in said first closed position, said first locking protrusion being frictionally retained within said first track second end when said cap is in said second open position, said cap being capable of rotation from said first closed position to said second open position only when said first and second squeeze points are biased inwardly such that said first locking protrusion is displaced from said impression.

13. The captive cap dispenser device closure of claim 12 wherein said cap top inner surface further includes an annular moisture vapor transfer plug, said moisture vapor transfer plug being in immediate contact with said neck inner surface when said cap is in said first closed position.

14. The captive cap dispenser device closure of claim 12 wherein said cap top inner surface further includes a desiccant retaining member.

15. The captive cap dispenser device closure of claim 12 wherein said cap is rotatable from said second open position to said first closed position by manually rotating said cap and without applying inward pressure to said squeeze points.

16. The captive cap dispenser device closure of claim 12 wherein said cap is manually rotatable from said second open position to said first closed position by applying downward pressure on said cap and without applying inward pressure to said squeeze points.

17. The captive cap dispenser device closure of claim 12 wherein said cap comprises said first recess track and said neck external surface comprises said first locking protrusion.

18. The captive cap dispenser device closure of claim 12 wherein said neck external surface comprises tamper notches and said cap comprises a corresponding removable notched tamper ring such that rotation of said cap from said first closed position to said second open position is only achieved by first manually removing said tamper ring.

19. The captive cap dispenser device closure of claim 12 wherein said cap annular sidewall outer surface comprises indicia means for indicating where said first and said second squeeze points are located.

20. A captive cap dispenser device closure comprising:

(a) a container having a base for holding contents, a neck and an open mouth, said neck defining said open mouth, said neck having an inner surface and an external surface, said neck external surface having at least a first recess track, said first recess track having a first end and a second end, said neck also having at least one locking protrusion holding means; and (b) a dispenser cap being manually rotatable between a first closed position and a second open position, said cap having means for non-removably retaining said cap to said neck of said container, wherein said cap comprises:

a top, said top having an inner surface, said top inner surface having a first annular sidewall extending therefrom, said first annular sidewall having an inner surface and an outer surface, said first annular sidewall having a dispensing orifice thereon such that said dispensing orifice is closed by said neck when said cap is in said first closed position and open when said cap is in said second open position, said first annular sidewall inner surface having at least a first recess track protrusion, said first recess track protrusion being frictionally confined within said first recess track, said top having a second annular sidewall extending therefrom, said second annular sidewall encircling and being parallel to said first annular sidewall and extending further than the same, said second annular sidewall having a dispensing orifice being in adjoining placement to said first annular sidewall dispensing orifice so as to function concurrently therewith, said second annular sidewall having an outer surface and an inner surface, said second annular sidewall outer surface having a first squeeze point and a second squeeze point opposite said first squeeze point, said second annular sidewall inner surface having at least a first locking protrusion, said first locking protrusion being retained by said locking protrusion holding means when said cap is in said first closed position, said cap being capable of rotation from said first closed position to said second open position only when said first and second squeeze points are biased inwardly such that said first locking protrusion is displaced from said locking protrusion holding means.

21. The captive cap dispenser device closure of claim 20 wherein said cap top inner surface further includes an annular moisture vapor transfer plug, said moisture vapor transfer plug being in immediate contact with said neck inner surface when said cap is in said first closed position.

22. The captive cap dispenser device closure of claim 20 wherein said cap top inner surface further includes a desiccant retaining member.

23. The captive cap dispenser device closure of claim 20 wherein said cap is rotatable from said second open position to said first closed position by applying downward pressure on said cap and without applying inward pressure to said squeeze points.

24. The captive cap dispenser device closure of claim 20 wherein said neck external surface comprises tamper notches and said cap comprises a corresponding removable notched tamper ring such that rotation of said cap from said first closed position to said second open position is only achieved by first manually removing said tamper ring.

25. The captive cap dispenser device closure of claim 20 wherein said cap outer annular sidewall outer surface comprises indicia means for indicating where said first and said second squeeze points are located.

26. The captive cap dispenser device closure of claim 20 wherein said locking protrusion holding means is an annular retention bead.

27. The captive cap dispenser device closure of claim 20 wherein said locking protrusion holding means is at least one impression.

* * * * *